US005224606A

United States Patent [19]

Gunderson

[11] Patent Number: 5,224,606

[45] Date of Patent: Jul. 6, 1993

[54] INFLATABLE BLADDER TYPE OF SCREEN TENSIONING DEVICE

[76] Inventor: Lawrence Gunderson, R.R. #1, Bawlf, Alberta, Canada, T0B 0J0

[21] Appl. No.: 944,689

[22] Filed: Sep. 14, 1992

[30] Foreign Application Priority Data

Oct. 4, 1991 [CA] Canada ..... 2052816

[51] Int. Cl.[5] ..... B07B 1/49

[52] U.S. Cl. ..... 209/403; 209/405

[58] Field of Search ..... 209/319, 363, 365.1, 209/403, 405, 413, 404; 210/388, 389

[56] References Cited

U.S. PATENT DOCUMENTS

| | | | |
|---|---|---|---|
| 2,279,042 | 4/1942 | Harrington | 209/403 |
| 3,176,843 | 4/1965 | Hoskins et al. | 209/403 |
| 3,203,548 | 8/1965 | Roubal | 209/403 X |
| 3,469,695 | 9/1969 | Greeninger | 209/403 |
| 3,655,045 | 4/1972 | McAllister, Jr. | 209/379 |
| 3,968,033 | 7/1976 | Illemann et al. | 209/403 |
| 4,137,157 | 1/1979 | Deister et al. | 209/403 |
| 4,568,455 | 2/1986 | Huber et al. | 209/405 |
| 4,744,898 | 5/1988 | Bailey | 210/236 |
| 4,816,153 | 3/1989 | Ando et al. | 210/445 |

FOREIGN PATENT DOCUMENTS 0839611 6/1981 U.S.S.R. ..... 209/405

*Primary Examiner*—Joseph E. Valenza
*Assistant Examiner*—Tuan N. Nguyen
*Attorney, Agent, or Firm*—Davis, Bujold & Streck

[57] ABSTRACT

In combination a unique design of inflatable bladder screen tensioning device, a plurality of securing pins, and a plurality of cotters. The inflatable bladder is positioned between a first elongate plate and a second elongate plate such that as the bladder is inflated the first elongate plate and the second elongate plate are forced apart. A plurality of openings extend through the first elongate plate, the inflatable bladder and the second elongate plate. The securing pins are of such a length that they can extend transversely through a screen engaging clamp, a screen retaining frame and thereafter through the openings in the first elongate plate, the inflatable bladder and the second elongate plate. Each of the securing pins is comprised of a shaft having a first end and a second end. A head is positioned at the first end such that the head engages screen engaging clamp. A transverse opening is positioned at the second end. The plurality of cotters each have a body portion which is adapted to extend through the transverse openings in the securing pins, and a head portion which will not pass through the transverse opening.

2 Claims, 2 Drawing Sheets

INFLATABLE BLADDER TYPE OF SCREEN TENSIONING DEVICE

The present invention relates to an inflatable bladder type of screen tensioning device.

BACKGROUND OF THE INVENTION

Inflatable bladder type screen tensionin9 devices are known in the prior art; as is exemplified by U.S. Pat. No. 3,655,045. They were developed for the purpose of expediting the time consuming and laborious task of replacing screens. Even with the use of inflatable bladder type of screen tensioning devices, the replacement of screen has remained time consuming due to the plurality of nuts which must be removed along the periphery of the screen before the screen can be removed.

SUMMARY OF THE INVENTION

What is required is an improved inflatable bladder type of screen tensioning device.

According to the present invention there is provided in combination a unique design of inflatable bladder screen tensioning device, a plurality of securing pins, and a plurality of cotters. The screen tensioning device is comprised of a first elongate plate, a second elongate plate, and an inflatable bladder positioned between the first elongate plate and the second elongate plate. The first elongate plate extends for substantially the length of a screen to be tensioned. The second elongate plate, similarly, extends for substantially the length of a screen to be tensioned. The inflatable bladder is positioned between the first elongate plate and the second elongate plate such that as the bladder is inflated the first elongate plate and the second elongate plate are forced apart. A plurality of openings extend through the first elongate plate, the inflatable bladder, and the second elongate plate. The securing pins are of such a length that they can extend transversely through screen engaging means of a screen retaining frame and thereafter through the aligned openings in the first elongate plate, the inflatable bladder and the second elongate plate. Each of the securing pins is openings in the first elongate plate, the inflatable bladder and the second elongate plate. Each of the securing pins is comprised of a shaft having a first end and a second end. A head is positioned at the first end such that the head engages screen engaging means. A transverse opening is positioned at the second end. The plurality of cotters each have a body portion which is adapted to extend through the transverse openings in the securing pins, and a head portion which will not pass through the transverse opening.

A screen can be removed by simply deflating the inflatable bladder and pulling the cotters out of the securing pins to allow removal of the screen tensioning device. Once the screen has been replaced the screen tensioning device can be mounted back on the securing pins, and the cotters reinserted into the transverse openings at the second end of each securing pin. Upon inflation of the inflatable bladder the first elongate plate and the second elongate plate move outwardly to provide the necessary tensioning force.

Although beneficial results may be obtained through the use of the combination as described, even more beneficial results may be obtained by securing a line from the head of each cotter to one of the first elongate plate and the second elongate plate. When a line is secured in this manner the cotters can be pulled rapidly and are maintained by the line in close proximity for reinsertion after a rapid change of the screen. No time need be lost in keeping track of a number of loose cotters.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
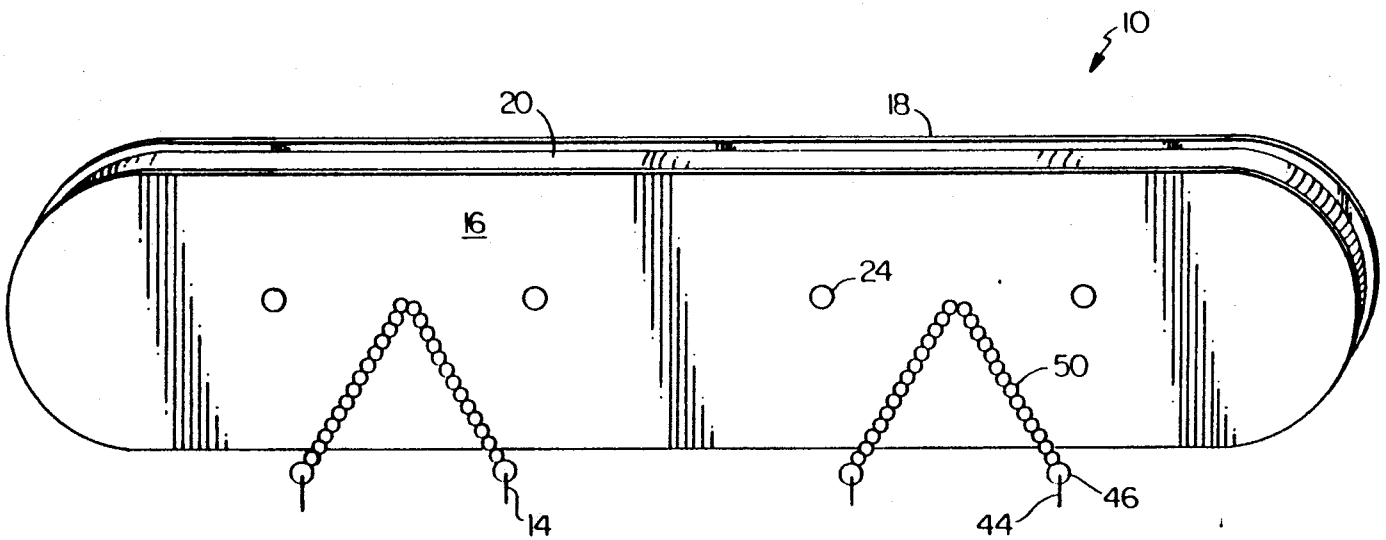
FIG. 1 is a perspective view of a preferred embodiment of the screen tensioning device.
Figure 2:
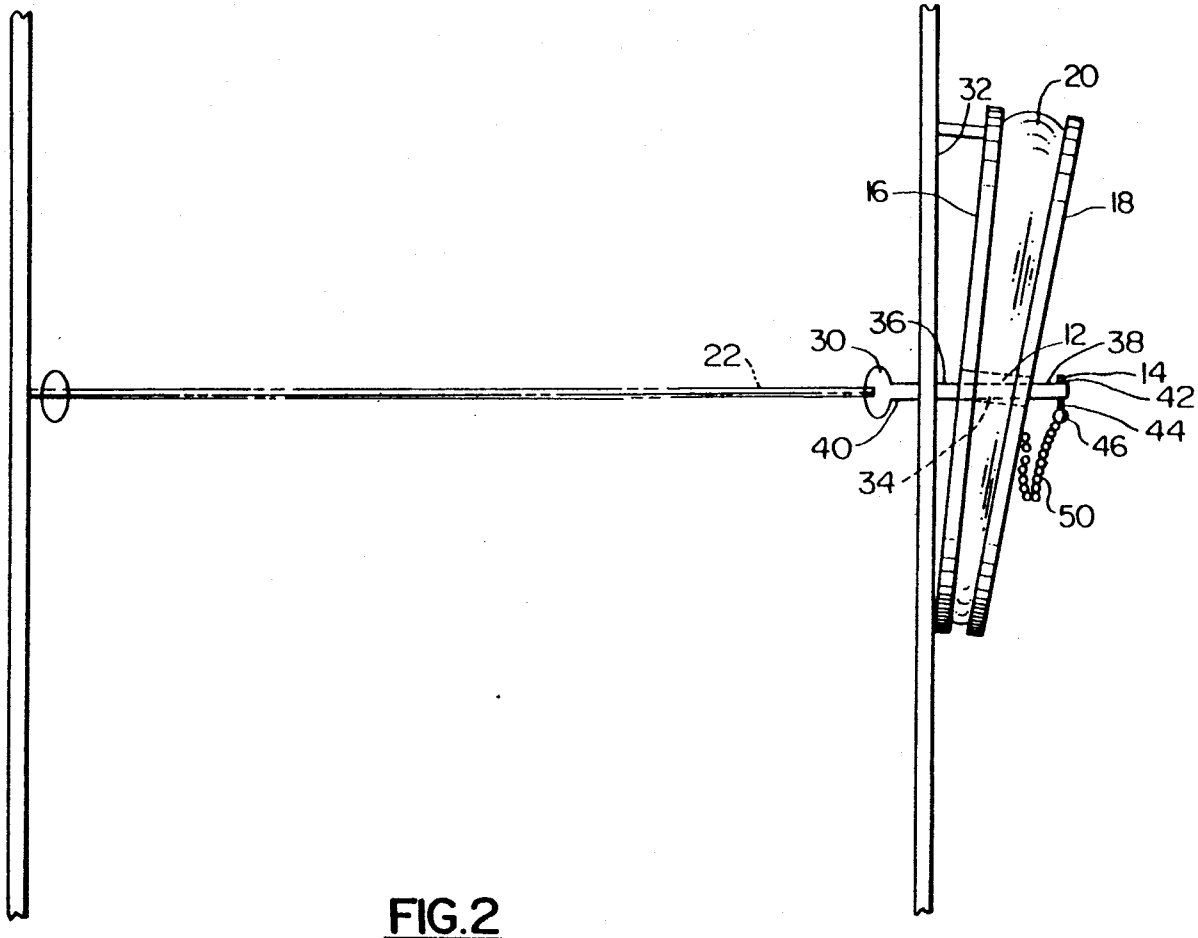
FIG. 2 is a transverse section view of the screen tensioning device in combination with the securing pin and cotter.

The combination will now be described with reference to FIGS. 1 and 2. The combination consists of a unique design of inflatable bladder screen tensioning device, generally referred to by reference numeral 10, a plurality of securing pins 12, and a plurality of cotters 14.

Screen tensioning device 10 consists of a first elongate plate 16, a second elongate plate 18, and an inflatable bladder 20 positioned between first elongate plate 16 and second elongate plate 18. First elongate plate 16 extends for substantially the length of a screen 22 to be tensioned. Second elongate plate 18, similarly, extends for substantially the length of screen 22. Inflatable bladder 20 is positioned between first elongate plate 16 and second elongate plate 18 such that as bladder 20 is inflated first elongate plate 16 and second elongate plate 18 are forced apart. A plurality of openings 24 extend through first elongate plate 16, inflatable bladder 20 and second elongate plate 18. Where openings 24 pass through inflatable bladder 20 openings 24 have sealed edges (not shown) to prevent leakage. Securing pins 12 are of such a length that they can extend transversely through screen engaging means, such as screen clamp 30 of a screen retaining frame 32 and thereafter through openings 24. Each of securing pins 12 consists of a shaft 34 having a first end 36 and a second end 38. A head 40 is positioned at first end 36 of shaft 34. A transverse opening 42 is positioned at second end 38 of shaft 34.

Cotters 14 each have a body portion 44 which is adapted to extend through transverse openings 42 in securing pins 12, and a head portion 46 which will not pass through transverse opening 42. A line 50 extends from head portion 46 of each of cotters 14 to first elongate plate 16.

The use and operation of the combination will now be described with reference to FIGS. 1 and 2. Screen 22, screen clamp 30 and screen retaining frame 32 do not form part of the invention and are merely shown for purposes of illustration. Screen 22 can be removed by simply deflating inflatable bladder 22 and pulling cotters 14 out of transverse openings 42 in securing pins 12 to allow removal of screen tensioning device 10. Cotters 14 can be pulled rapidly and dropped as they are maintained by line 50 in close proximity for reinsertion into transverse openings 42. Once screen 22 has been replaced screen clamp 30 is put back into position and securing pins 12 are inserted through screen clamp 30 and through screen retaining frame 32. Screen tensioning device 10 is then slid back onto second end 38 of shaft 34 of securing pins 12. In placing screen tensioning device 10 back into position securing pins 12 pass through openings 24. Cotters 14 are then reinserted into transverse openings 42 at second end 38 of shaft 34 of each securing pin 12. Upon inflation of inflatable bladder 20, first elongate plate 16 and second elongate plate 18 move outwardly to provide the necessary tensioning force.

It will be apparent to one skilled in the art the benefits provided by the described combination. Firstly, screen tensioning device 10 provides a tensioning force along the entire length of screen 22. This avoids problems with uneven tensioning which exist in the prior art. Secondly, no special modifications are required to screen clamp 30 or screen retaining screen 32 in order to make them compatible with screen tensioning device. This permits screen tensioning device to be used with a variety of screen clamp and screen retaining frame configurations. Thirdly, the combination permits the changing of screen 22 to take place within a much reduced time frame than is possible with the prior art.

The embodiments of the invention in which an exclusive property or privilege is claimed are defined as follows:

1. In combination:

a. a screen tensioning device, comprising:

i. a first elongate plate extending for substantially the length of a screen to be tensioned;

ii. a second elongate plate extending for substantially the length of a screen to be tensioned;

iii. an inflatable bladder positioned between the first elongate plate and the second elongate plate, such that as the bladder is inflated the first elongate plate and the second elongate plate are forced apart;

iv. a plurality of openings extending through the first elongate plate, the second elongate plate, and the inflatable bladder, the portion of the openings extending through the inflatable bladder being sealed to prevent leakage;

b. a plurality of securing pins adapted to extend transversely through screen engaging means of a screen retaining frame and through the aligned openings in the first elongate plate, the inflatable bladder and the second elongate plate, the securing pins comprising:

i. a shaft having a first end and a second end;

ii. an enlarged head at the first end;

iii. a transverse opening through the second end; and c. a plurality of cotters each having a body portion which is adapted to extend through the transverse openings in the securing pins, and a head portion which will not pass through the transverse opening.

2. The combination as defined in claim 1, a line being secured from the head of each cotter to one of the first elongate plate or the second elongate plate.

* * * * *